United States Patent [19]

Kurtz

[11] 3,931,723

[45] Jan. 13, 1976

[54] LOCK FOR SLIDING CLOSURE PANELS

[76] Inventor: Thomas D. Kurtz, 1101 First Ave., Rock Falls, Ill. 61071

[22] Filed: Apr. 3, 1975

[21] Appl. No.: 564,612

[52] U.S. Cl. ..... 70/14
[51] Int. Cl.[2] ..... E05B 65/08
[58] Field of Search ..... 70/14, 95, 99, 100; 292/262, 269, 270

[56] References Cited

UNITED STATES PATENTS

| | | | |
|---|---|---|---|
| 2,050,696 | 8/1936 | Schoorel | 70/95 |
| 2,172,208 | 9/1939 | Kurtzon | 70/14 |

*Primary Examiner*—Richard E. Moore
*Attorney, Agent, or Firm*—Morsbach & Pillote

[57] ABSTRACT

A lock for locking by-passing type slidable closure panels in a closed position with adjacent ends of the panels in spaced overlapping relation. The lock includes a lock housing mounted on one of the panels and having a lock plug mounted for axial sliding and rotary movement about an axis perpendicular to the panels, and an elongated keeper on the other of the panels. The lock plug has a rotary latch member on its forward end engageable with the keeper when the plug is extended and rotated to a preselected position to hold the plug in its extended position, and the plug also has latch means at its forward end engageable with the keeper to lock the plug and keeper against relative movement in one direction crosswise of the plug axis. The lock housing and keeper are advantageously adhesively secured to the inner and outer panels respectively so that the lock and keeper can be mounted without requiring drilling of the panels and the lock and keeper remain in position on the panels when unlocked.

28 Claims, 16 Drawing Figures

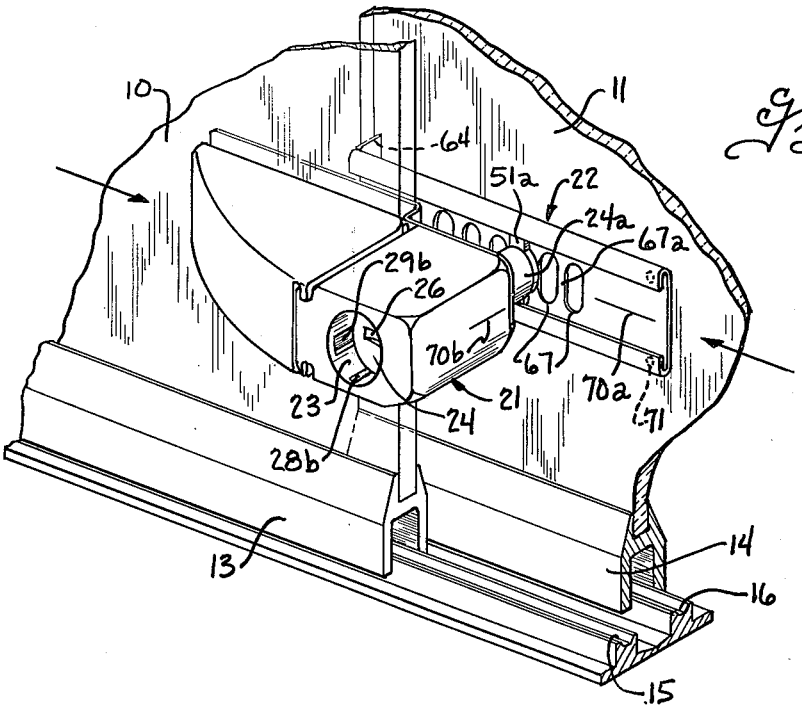
Fig. 1.
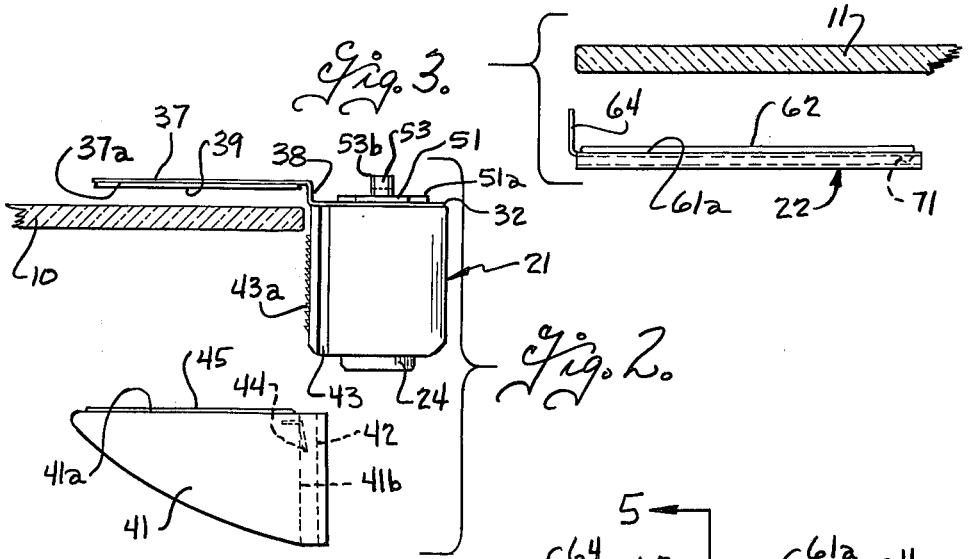
Fig. 3.
Fig. 2.
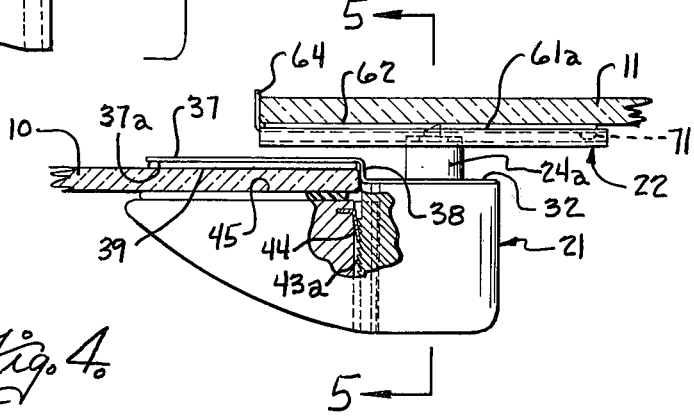
Fig. 4.

Fig. 5.
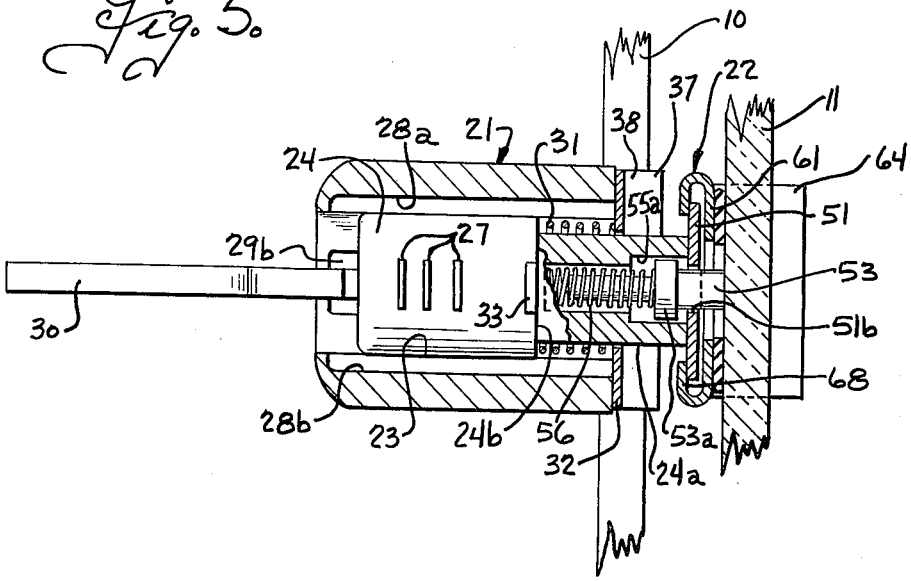
Fig. 6.
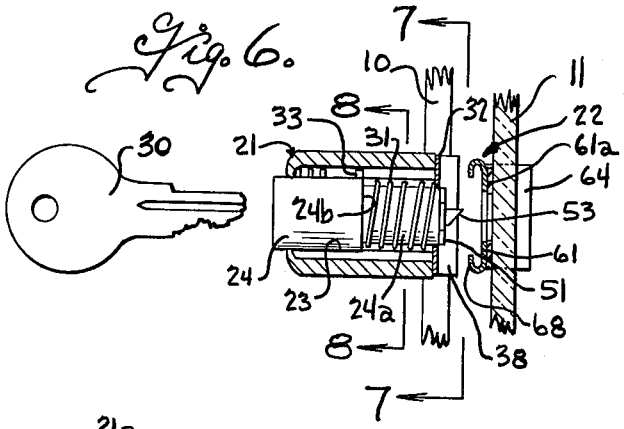
Fig. 9.
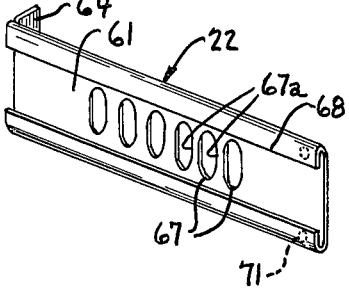
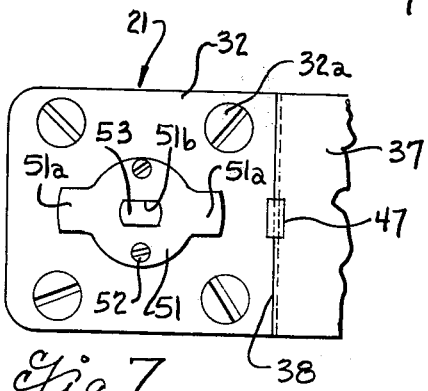
Fig. 7.
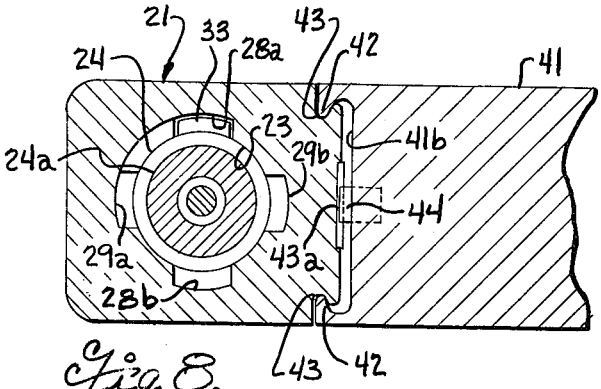
Fig. 8.

Fig. 10.
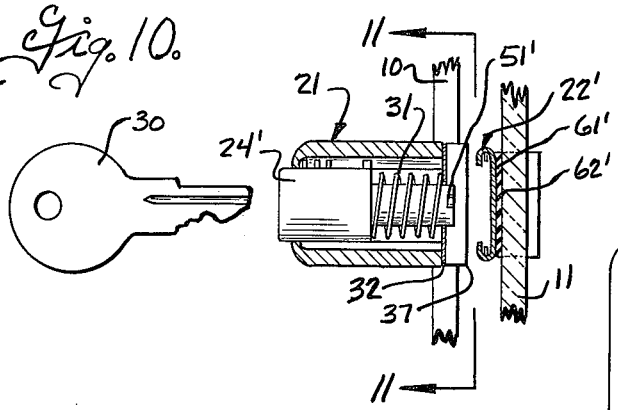
Fig. 16.
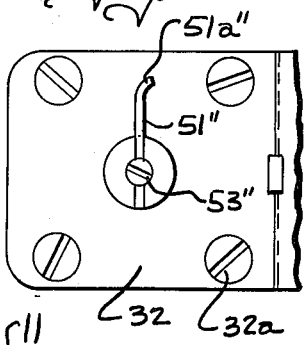
Fig. 12.
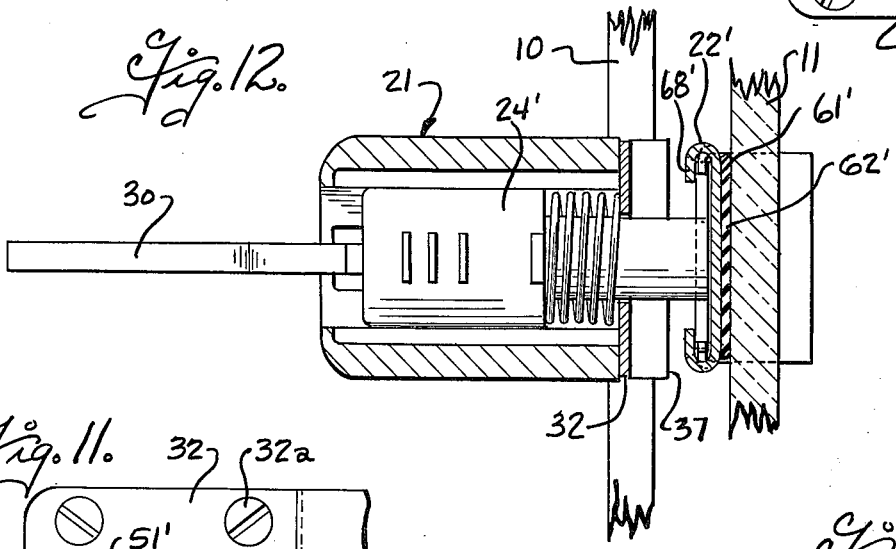
Fig. 11.
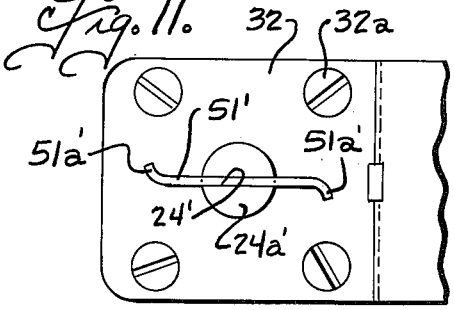
Fig. 13.
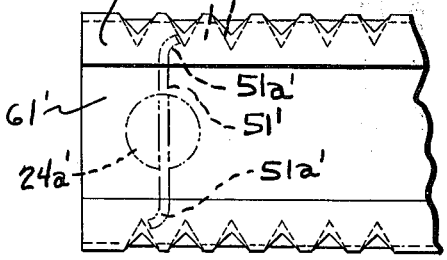
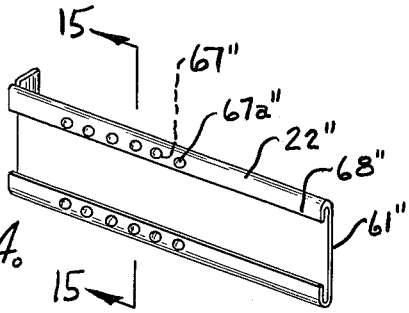
Fig. 14.
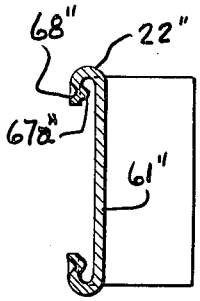
Fig. 15.

LOCK FOR SLIDING CLOSURE PANELS

BACKGROUND OF THE INVENTION

In by-passing type slidable closures, the thickness of the closure panels as well as the spacing between the closure panels and the amount of overlap between the closure panels varies in different installations. Moreover, in the glass-type slidable closures such as are commonly used in showcases, it is difficult to drill or otherwise form mounting holes in the glass panels.

So-called ratchet-type locks are commonly used for locking glass-type closure panels and include a ratchet bar which is clipped to the inner closure panel and a separate lock member which is slidable onto the ratchet bar to engage the edge of the outer closure panel for locking the closure panels in a closed condition. Such ratchet-type locks, however, are not permanently attached to the closure panels and comprise two entirely separate pieces which must be disassembled for unlocking and then reassembled in order to lock the closure panels. This not only makes the use of such ratchet-type locks more difficult and time consuming but also increases the likelihood of loss of one or more of the parts of the lock when they are removed from the panels. Moreover, the chip on type ratchet bars tend to chip the edge of the glass panels during use and, when tempered glass panels are used, chipping of the edge of the glass panel may cause fragmentating of the entire panel.

It has also been proposed to mount a plunger-type lock on a frame member attached to the edges of the sliding glass panels and movable therewith. Such plunger-type locks are in the form of a key operated bolt which is mounted in a lock housing attached to the frame member on the outer panel and the bolt is movable perpendicular to the outer panel into an opening in the frame member on the inner closure panel. Such plunger-type locks can only be mounted on sliding glass panels which have frame members movable therewith and, moreover, require considerable time and skill to drill the frame members and mount the locks. Further, the hole in the inner panel for receiving the plunger must be accurately aligned with the plunger when the doors are closed and this further complicates the problem of mounting the plunger-type locks.

SUMMARY OF THE INVENTION

It is a general object of the present invention to porvide a lock for by-passing type closure panels which overcomes the problems encountered with prior locks for sliding closure panels.

An important object of this invention is to provide a lock for by-passing type closure panels which can be permanently mounted on the panels to facilitate locking and unlocking of the closure panel, and which will not interfere with movement of the panels between an open and closed position when the lock is in an unlocked condition.

Another object of this invention is to provide a lock for by-passing type closure panels which can be easily mounted on the closure panels and which does not require any drilling or other special machining or cutting of the panels in order to effect mounting of the lock.

A more particular object of this invention is to provide a lock for sliding closure panels in accordance with the foregoing object in which the lock is adhesively secured to one of the panels and the keeper is adhesively secured to to other of the panels and in which the lock and keeper are constructed and arranged to hold the panels in a locked condition, when the lock and keeper are locked together, even if the adhesive bond between one or both of the lock members in their respective panel is disrupted.

Other important objects of this invention are to provide a lock for by-passing type closure panels which accommodate panels of different thickness; which can accommodate different panel-to-panel spacing; and which can accommodate different panel overlap, without change in the lock.

Still another object of this invention is to provide a lock for by-passing type closure panels which inhibits removal of the panels from the trackways when in a locked condition.

Further objects of the invention will be apparent from the following description when taken in connection with the accompanying drawings wherein:

FIG. 1 is a fragmentary perspective view of a lock embodying the present invention and shown mounted on a pair of by-passing type closure panels;

FIG. 2 is an exploded view illustrating mounting of the lock housing on one of the closure panels;

FIG. 3 is a fragmentary exploded view illustrating the mounting of the keeper on the other of the closure panels;

FIG. 4 is a fragmentary horizontal sectional view taken on the plane 4—4 of FIG. 1 with parts broken away and shown in section to illustrate details of construction;

FIG. 5 is a fragmentary vertical sectional view taken on the plane 5—5 of FIG. 4 showing the lock in a locked condition and on a larger scale that FIG. 4;

FIG. 6 is a fragmentary vertical sectional view taken on the plane 5—5 of FIG. 4 illustrating the lock in an unlocked condition;

FIG. 7 is a fragmentary view taken on the plane 7—7 of FIG. 6;

FIG. 8 is a fragmentary vertical sectional view taken on the plane 8—8 of FIG. 6;

FIG. 9 is a perspective view of the keeper;

FIG. 10 is a sectional view through a modified form of lock illustrating the same in an unlocked condition;

FIG. 11 is a fragmentary view taken on the plane 11—11 of FIG. 10 and on a larger scale than FIG. 10;

FIG. 12 is a sectional view through the lock of FIG. 10 illustrating the same in a locked condition and on a larger scale than FIG. 10;

FIG. 13 is a fragmentary view illustrating one form of keeper for the lock of FIG. 10;

FIG. 14 is a perspective view illustrating another form of keeper for the lock of FIG. 10;

FIG. 15 is a sectional view taken on the plane 15—15 of FIG. 14;

FIG. 16 is a fragmentary view illustrating a modified form of latch for use on the lock of FIG. 10.

The lock of the present invention is generally adapted for use on by-passing type closure panels and particularly for use on sliding glass panels of the type commonly used in showcases and the like. The lock is shown applied to outer and inner by-passing type closure panels 10 and 11 which are respectively slidable on outer and inner parallel tracks. Various different trackways can be used to slidably support the by-passing type panels, some of which trackways are arranged to directly receive the edges of the panels and other of which trackways are arranged to receive frame members on the edges of the panels. In the embodiment illustrated, metal frame members 13 and 14 are attached to the outer and inner panels 10 and 11 respectively and contain rollers (not shown) which engage outer and inner trackways 15 and 16 to slidable support the panels for endwise movement. Trackways are also provided at the upper edges of the panels to maintain the same in spaced parallel relation and the upper trackways are usually in the form of downwardly opening channels that slidably receive either the edges of the panels or frames attached to the edges of the panels. The details of construction of the trackways for slidably supporting the panels form no part of the present invention and further detailed description and illustration is deemed unnecessary.

The lock in general includes a lock housing 21 which is mounted on the outer panel 10 and a keeper 22 which is mounted on the inner panel 11. The lock housing 21 has a generally cylindrical passage 23 extending therethrough and a lock plug 24 which is mounted in the passage 23 for axial sliding and rotary movement relative to the housing under the control of a key 30. The lock can be of the disk or pin tumbler type and is herein shown as a disk tumbler type having a plurality of disks 27 which are normally biased by springs (not shown) outwardly of the plug to project into one set of opposed grooves 28*a* 28*b* (FIG. 8), and the disks are retracted when the key is inserted into a keyway 26 in the plug so that the plug can be rotated to a second angular position in which the disks register with a second pair of opposed grooves 29*a* and 29*b* in the housing. Thus, the disks 27 normally project into one pair of opposed grooves 28*a*, 28*b* in the lock housing to hold the plug against rotation, and the disks 27 are retracted into the plug when the key 30 is inserted into the keyway so that the plug can be rotated to a second position in which the disks register with a second pair of grooves 29*a* and 29*b*. When the key 30 is withdrawn from the keyway, the disks move outwardly from the plug and into the grooves 29*a* and 29*b* to lock the plug in the second position. The plug 24 has a reduced diameter portion 24*a* defining a shoulder 24*b* intermediate its ends and the plug is yieldably urged in an axial direction to a retracted position as shown in FIG. 6 by a spring 31 disposed around the reduced diameter portion 24*a* between the shoulder 24*b* and a cover plate 32 on the end of the lock housing. As shown in FIG. 7, the cover plate 32 is conveniently secured to the housing 21 by fasteners 32*a*. For reasons pointed out more fully hereinafter, provision is made for inhibiting rotation of the plug relative to the housing, when the key is inserted, until the plug has been moved axially in a forward direction a preselected distance. This is achieved by a lug 33 on the plug which is slidable in one of the grooves 28*a* to normally prevent rotation of the plug, and an arcuate cross groove 35 is provided in the housing extending between the groove 28*a* and an adjacent groove 29*a*, at a location along the grooves to allow turning of the plug only when the plug has been extended to a preselected position in which the forward end of the plug is adjacent the inner closure panel 11.

The lock 21 is mounted on the outer panel 10 by a mounting plate 37 that extends laterally from the lock housing and which has a flat attaching face 37*a* disposed in a plane perpendicular to the axis of the lock plug 24. The mounting plate 37 is conveniently integrally connected to the cover plate 32 by a transverse portion 38 that forms a shoulder adapted to engage and position the lock housing at the edge of the outer panel 10. The transverse portion 38 is also arranged to offset the lock housing 21 outwardly from the inner face of the outer panel 10 to provide adequate clearance between the lock and keeper for free sliding of the panels, even with a very small panel-to-panel spacing. The lock housing is advantageously adhesively mounted on the outer panel so as to avoid the necessity of drilling or otherwise cutting into the glass panels. The adhesive is preferably in the form of a double coated pressure sensitive adhesive tape indicated at 39. Alternatively, an adhesive coating could be applied directly to the attaching face 37*a* of the mounting plate. The actual thickness of the adhesive layer has been exaggerated somewhat in the drawings for purpose of illustration and the adhesive layer is preferably made only sufficiently thick to accommodate minor irregularities and to assure a good bond between the mounting plate and panel.

Provision is advantageously made for strengthening the mounting of the lock housing on the outer panel. In the preferred embodiment illustrated, a second lock mounting member 41 is provided for engaging the outer side of the outer panel and interfitting guideways are formed on the second lock mounting member and on the lock housing to support the second lock mounting member for sliding movement on the lock housing in a direction perpendicular to the face 37*a* on the mounting plate 37. In the embodiment shown, the second lock mounting member 41 has a flat attaching face 41*a* and a recess 41*b* at one side disposed at right angles to the face 41*a*. The body has inwardly directed flanges 42 along opposite sides of the recess 41*b* and which are adapted to be received in grooves 43 on the lock housing to slidably interconnect the second lock mounting member 41 and the lock housing. In order to inhibit separation of the second lock mounting member and the lock housing, ratchet teeth 43*a* are provided on the side face of the lock housing and a resilient pawl 44 is provided on the member 41 to engage the ratchet teeth and inhibit movement of the member 41 in a direction away from the mounting plate 37. The attaching face 41*a* of the second lock mounting member 41 is also advantageously adhesively secured to the panel 10, as by an adhesive coating or a pressure sensitive double coated adhesive tape indicated at 45. An opening 47 (FIG. 7) is advantageously provided in the transverse member 38 to allow insertion of a tool for engagement with the resilient pawl 44 to release the latter, in the event it is desired to remove the lock from the outer panel for purposes of replacement of the panel or the like.

The plug has a rotary latch member 51 mounted on its forward end as by fasteners 52 for axial and rotary movement with the plug and the rotary latch member is arranged to engage the keeper 22 on the inner panel to lock the plug and keeper against relative movement in a direction axially of the plug, when the plug is in its locked condition. In the preferred embodiment of FIGS. 1–9, the plug also has a reciprocable latch bolt 53 which is mounted on the plug for axial sliding movement relative thereto and which is also engageable with the keeper 22 to lock the plug and keeper against relative movement in one direction crosswise of the plug when the plug is in its locked condition. As best shown in FIG. 7, the rotary latch member has oppositely extending latch ears 51*a* which are disposed in a direction generally parallelling the direction of movement of the panels when the plug is in its unlocked position, and which extend generally transverse to the direction of movement of the panels when the plug is in its locked condition shown in FIG. 1. The reciprocable latch bolt 53 extends through an opening 51*b* in the rotary latch member and the bolt is yieldably urged forwardly of the rotary latch member by a spring 56. As best shown in FIG. 5, the plug 24 has a stepped bore 55*a* which is closed at its outer end by the rotary latch member and the spring 56 is interposed between the plug and an enlarged collar 53*a* on the latch bolt. The collar 53*a* cooperates with the stepped bore and the rotary latch member to provide stops to limit extension and retraction of the bolt.

The keeper 22 is in the form of an elongated plate 61 which has a flat attaching face 61*a* at one side adapted to be secured to the outer face of the inner panel 11. The flat attaching face is advantageously adhesively secured to the outer face of the inner panel as by an adhesive 62 to avoid the necessity of drilling or cutting of the panel. As described in connection with mounting of the lock on the outer panel, the adhesive 62 is preferably in the form of a double coated pressure sensitive tape, it being understood that the adhesive could also be in the form of an adhesive coating applied directly to the face 61*a*. A stop flange 64 is provided at one end of the keeper plate 61 to engage the edge of the inner panel 11 to not only locate the keeper on the inner panel but to also provide a stop for preventing movement of the keeper in one direction relative to the inner panel. The keeper has inwardly directed flanges 68 along its opposite side edges which are spaced from the side of the plate 61 opposite the attaching face 61*a* to define opposed grooves or channels extending lengthwise of the keeper plate for receiving the latch ears 51*a* on the rotary latch member 51, when the plug is turned to its locked position. The latch plate also has means providing bolt receiving recesses at longitudinally spaced locations therealong for receiving the latch bolt 53 with the edges of the recesses defining shoulders or stops for engaging the latch bolt to lock the plug and keeper against relative movement in one direction crosswise of the plug axis. As will be seen from FIG. 1, the panels will be held in their closed position if the keeper and plug are locked against relative movement crosswise of the plug axis in the direction of the arrows in FIG. 1 and the spaced recesses are shaped to define spaced stops on the keeper to lock the keeper and plug against relative movement in this direction. In the embodiment shown, the recesses are in the form of openings that extend through the plate 61 and which define stop bars on teeth 67*a* intermediate the openings. It is apparent, however, that the recesses do not have to extend completely through the plate 61 and may be in the form of sharp edged depressions on the plate. For reasons pointed out more specifically hereinafter, a stop, conveniently in the form of small protrusions 71, is provided on the keeper 22 to engage the rotary latch member and prevent movement of the rotary latch member out of the end of the keeper, when the plug is in its locked condition. If desired, the end 53*b* of the latch bolt can be bevelled as best shown in FIG. 2 so that the bolt can ratchet to allow relative movement between the panels in a direction to close the panels, but will provide an abutment engageable with the stop bars 67*a* to prevent opening movement of the panels (in the direction of arrows in FIG. 1). The bolt is preferably made non-circular in cross-section and extends through a corresponding non-circular opening 51*b* on the rotary latch (FIG. 7) to maintain the bolt properly oriented.

The embodiment of FIGS. 10–13 is generally similar to that of FIGS. 1–9 and like numerals followed by the postscript (′) are used to designate modified parts. In this embodiment the parts are the same as previously described except that a modified rotary latch member 51′ is mounted on the end of the plug 24′ for axial and rotary movement therewith and is arranged to engage a modified keeper 22′ to both hold the plug in an extended position and lock the plug and keeper against relative movement in a direction crosswise of the plug. As best shown in FIG. 13, the keeper 22′ is formed with inwardly directed flanges 68′ along opposite edges that define opposed grooves extending lengthwise of the keeper and the keeper is also formed with teeth 67*a* that extend inwardly of the channels at spaced locations therealong to form spaced recesses 67′ along the channels. In the embodiment, the teeth are conveniently formed by generally wedge shaped indentations in the base of the channel. In the keeper 22″ shown in FIGS. 15 and 16, teeth 67*a*″ are formed by spaced indentations in the flange 68″ to provide recesses 67″ at spaced locations along the keeper plate 61″. The rotary latch member 51′ is conveniently formed of spring steel with curved ends 51*a*′ dimensioned to move into opposed recesses in the keeper and engage the teeth therein as best shown in FIG. 13, when the plug is extended and rotated in its locked position. The keeper 51′ is conveniently mounted in a cross groove 24′ in the end 24*a*′ of the plug and retained in the groove by swaging the end of the plug. As will be seen from FIG. 13, the rotary latch member 51′ having dual locking ends 51*a*′ will lock the keeper against movement crosswise of the plug axis in either direction of movement of the panels. If desired, a rotary latch member 51″ having a single curved end 51*a*″ can be provided as shown in FIG. 16 to allow the keeper to ratchet in one direction relative to the plug for closing of the panels. The keeper 51″ is preferably removably mounted in the end of the plug by a screw fastener 53″ to enable reversing of the rotary latch member 51″ for right and left hand panels.

From the foregoing, it is thought that the construction and operation of the lock will be readily understood. The lock housing 21 mounted on the outer panel by positioning the transverse portion 38 against the edge of the outer panel and by pressing the adhesive coating 39 on the mounting plate against the inner face of the outer panel. Thereafter, the second mounting member 41 is attached to the lock housing with its face 41*a* adhesively bonded to the outer side of the outer panel. This stiffens and reinforces the mounting of the lock housing on the outer panel and, moreover, provides a double faced bond between the housing and the outer panel to inhibit unauthorized removal of the lock housing from the outer panel. The keeper is mounted on the inner panel by engaging the stop 64 against the edge of the inner panel and pressing the adhesive on the attaching face 61*a* against the outer face of the inner panel. Guidelines 70*a* and 70*b* (FIG. 1) are conveniently provided on the keeper and lock housing to facilitate alignment of the keeper with the plug axis. The adhesive attachment of the mounting plate 37 of the lock housing to the inner face of the outer panel and the adhesive attachment of the keeper to the outer face of the inner panel in the regions where the panels overlap makes it difficult to remove the adhesively attached lock and keeper when the panels are closed. However, in order to prevent opening of the closure panels in the event someone is able to separate the keeper from the inner panel by inserting a cutting or prying tool between the panel and the keeper, the stop 64 on the end of the keeper is extended laterally of the keeper a distance sufficient to remain in engagement with the edge of the inner panel, even if the keeper is separated from the inner panel and moved laterally away from the inner panel until it engages the outer panel. Stated otherwise, the distance from the front side of the keeper 24 to the rear edge of the stop 64 on the keeper is made greater than the maximum panel-to-panel spacing which would be encountered in normal installations.

The lock is key operated and is first moved axially to position the rotary latch member 51 between the flanges on the keeper and the plug is then rotated to a second angular position shown in FIG. 2 in which the ears 51*a* on the rotary latch underlies the flanges on the keeper. This locks the plug against retraction and also locks the keeper against separation from the plug in the event the keeper is somehow separated from the inner panel. In addition, the reciprocable lock bolt 53 extends into the keeper recesses and engages the intermediate stop bars 67*a* to lock the plug and keeper against relative movement in the direction indicated by the arrows in FIG. 1 crosswise of the plug. This locks the panels against relative movement in a direction to open the panels. In the event the resilient bolt 53 does not register with one of the openings 67 in the keeper when the plug is extended and rotated to its locked position, the bolt will automatically engage in a recess to lock the panels against opening, as soon as either panel is moved slightly relative to the other. Moreover, it will be seen that, when the rotary latch member is located in the keeper, the forward end of the bolt 53 is effectively enclosed to prevent unauthorized retraction of the bolt. The stop projections 71 at the end of the keeper are arranged to engage the rotary latch member when the latter is in its locked position to prevent opening of the panels in the event the bolt 53 fails to engage in one of the recesses 67 or the keeper becomes separated from the inner panel.

In the embodiments of FIGS. 10–16, the rotary latch member is movable axially with the plug to a position between the opposed channels when the plug is extended and, when the plug is rotated to its locked position, the ends rotary latch member move into the channels to hold the plug in its extended position and are also positioned to engage the teeth in the channels to lock the panels against opening. The rotary latch members 51′ and 51″ are formed of spring steel with ends curved opposite the direction of rotation of the plug to its locked position, to cam over the teeth in the channels, in the event the recesses in the channels are not properly aligned with the plug axis.

In the drawings and specification, there has been set forth preferred embodiments of the invention, and although specific terms are employed, these are used in a generic and descriptive sense only and not for purpose of limitation. Changes in form and proportion of parts as well as substitution of equivalents are contemplated, as circumstances may suggest or render expedient, without departing from the spirit and scope of this invention, as further defined in the following claims:

The embodiments of the invention in which an exclusive property or privilege is claimed are defined as follows:

1. A lock for use on outer and inner by-passing type closure panels respectively slidable endwise on outer and inner parallel tracks into and out of a closed position with one end of each the outer and inner panels in spaced overlapping relation, said lock being adapted to lock the panels in a closed position and comprising a lock housing having a lock plug mounted therein for axial sliding and rotary movement, a mounting plate rigid with the housing and extending laterally therefrom with a flat attaching face on one side of the mounting plate disposed in a plane perpendicular to the plug axis, adhesive means on said attaching face for adhesively securing said mounting plate to the inner side of the outer panel with the plug offset from said one end of the outer panel and extending perpendicular to the plane of the outer panel, a keeper plate having a flat attaching face on one side and adhesive means on said flat attaching face for adhesively securing the keeper plate to the outer side of the inner panel adjacent said one end thereof, said plug having a keyway and key operated means controlling rotation of said plug, said plug being axially movable from a retracted position in which the forward end of the plug is adjacent the housing to an extended position in which the forward end of the plug is adjacent said keeper plate and said plug being angularly movable between first and second angular positions under the control of said key, and latch means on the forward end of said plug and keeper means on the keeper plate operative to engage said latch means when the plug is extended and rotated to said second position to lock the plug against retraction to said first position and to lock said keeper plate against movement in the direction crosswise of the plug.

2. The combination of claim 1 wherein said keeper means on said keeper plate includes at least one groove generally paralleling the direction of sliding movement of the inner panel and opening in a direction corsswise of the plug axis and a plurality of keeper recesses adjacent the groove and spaced lengthwise therealong, said latch means on the plug including a rotary latch member shaped to be positioned out of the groove on the keeper plate when the plug is in said first angular position and to extend into the groove on the keeper plate and hold the plug in its extended position when the plug is rotated to said second angular position, and a second latch member on said plug extending forwardly of said rotary latch member for engagement with said keeper recesses to lock the plug and keeper plate against relative movement in a direction crosswise of the plug.

3. The combination of claim 2 wherein said second latch member comprises a latch bolt mounted on the plug for axial sliding movement relative thereto, and means yieldably urging said bolt in one axial direction relative to the plug to yieldably project the forward end of the bolt to a position forwardly of said rotary latch member.

4. The combination of claim 3 including spring means between the plug and the housing yieldably urging the plug to a retracted position.

5. The combination of claim 1 including a second lock mounting means rigidly connected to said lock housing and extending laterally therefrom and defining a second flat attaching face paralleling said flat attaching face on the mounting plate for engaging the outer side of the outer panel.

6. The combination of claim 1 including a second lock mounting member, guide means on said lock housing and said second lock mounting member supporting the latter for for sliding movement relative to the lock housing in a direction perpendicular to said flat attaching face on the mounting plate, said second lock mounting member having a face paralleling said first attaching face on the mounting plate for clamping the outer panel therebetween.

7. The combination of claim 6 including adhesive means attaching said face on said second lock mounting member to said outer face of said second panel.

8. The combination of claim 6 including latch means between said lock housing and said second lock mounting member for restricting movement of said second lock mounting member in a direction away from said mounting plate.

9. The combination of claim 1 wherein said adhesive means comprises a pressure sensitive adhesive.

10. The combination of claim 1 wherein said adhesive means comprises a double faced pressure sensitive adhesive tape.

11. The combination of claim 1 including an abutment on one end of said keeper plate extending laterally from said flat attaching face for engagement with one edge of the inner closure panel.

12. The combination of claim 1 wherein said flat attaching face on said mounting plate is offset forwardly from the latch means on the forward end of the plug when the plug is in its retracted position.

13. The combination of claim 12 including means for restricting rotation of the plug relative to the housing until the plug is extended to a position adjacent the keeper plate.

14. The combination of claim 1 wherein said keeper means on said keeper plate includes a pair of inwardly directed flanges extending along opposite lenghwise edges of the keeper plate and spaced from the other side of the keeper plate to form a pair of grooves paralleling the direction of sliding movement in the inner panel and opening in a direction crosswise of the keeper axis, said keeper means also including a plurality of keeper openings at spaced locations along the keeper plate between the flanges, the latch means on the plug including a rotary latch member shaped to be receivable between the flanges on the keeper plate when the plug is in said first angular position and to underlie the flanges and hold the plug in its extended position when the plug is rotated to said second angular position, and a second latch member on said plug extending forwardly of said rotary latch member for engagement in a keeper opening to lock the plug and keeper plate against relative movement in one direction crosswise of the plug.

15. The combination of claim 1 wherein said keeper means on said keeper plate includes at least one groove generally paralleling the direction of sliding movement of the inner panel and opening in a direction crosswise of the plug axis and a plurality of teeth at spaced locations along the groove in the keeper plate, said latch means on the plug including a rotary latch member shaped to be positioned out of the groove in the keeper plate when the plug is in said first angular position and to extend into the groove in the keeper plate between adjacent ones of the teeth therein to hold the plug in its extended position and to lock the plug and keeper plate against relative movement in a direction crosswise of the plug.

16. The combination of claim 15 wherein said teeth extend into the groove from the base thereof.

17. The combination of claim 15 wherein said teeth extend into said groove from one side therof.

18. A lock for use on by-passing type closure panels to lock the panels in a closed position with adjacent end portions of the panels in spaced overlapping relation, said lock comprising a lock housing having means for mounting the same on one of the closure panels, a lock plug mounted in the lock housing for axial sliding and rotary movement about an axis perpendicular to said one panel, the plug having a keyway and key operated means controllong rotation of the plug, said plug being axially movable from a retracted position in which the forward end of the plug is adjacent the housing to an extended position in which the forward end of the plug is spaced forwardly from the housing and said plug being angularly movable between first and second angular positions under the control of the key, an elongated keeper adapted for mounting on the other of the by-passing closure panels parallel its direction of movement and having at least one lengthwise groove opening in a direction crosswise of its plug axis and a plurality of keeper teeth adjacent the groove and spaced lengthwise of the keeper, a rotary latch member mounted on the forward end of the plug shaped to be positioned out of the groove on the keeper when the plug is in said first angular position and to extend into the groove on the keeper and hold the plug in its extended position when the plug is rotated to said second angular position, and means operative when plug is in its second angular position to engage one of the teeth on the keeper to lock the plug and keeper plate against relative movement in one direction crosswise of the plug.

19. A lock according to claim 18 including spring means between said plug and housing yieldably urging said plug to said retracted position.

20. A lock according to claim 18 wherein said latch means comprises a bolt mounted on said plug for azial sliding movement relative thereto, and means yieldably urging said bolt in an axial direction to project the forward end of the bolt to a postion forwardly of said rotary latch member.

21. A lock according to claim 18 wherein said keeper includes an elongated base plate adapted to be mounted flush against the other of said by-passing closure panels and having flanges along opposite side edges spaced from the base plate to provide a pair of lengthwise extending grooves, said keeper teeth being formed in the base plate between the flanges.

22. A lock according to claim 18 wherein said means for mounting said lock housing comprises a mounting plate rigid with said housing and extending laterally therefrom with a flat attaching face disposed in a plane perpendicular to the plug axis, adhesive means on said attaching face for adhesively securing said mounting plate to one closure panel, said keeper having a flat mounting face and adhesive means on said flat mounting face for ashesively securing said keeper to the other closure panel.

23. A lock according to claim 18 wherein said keeper teeth are located in said groove in the keeper and said rotary latch member has at least one end portion adapted to extend into the groove between the teeth therein when the plug is rotated to said angular position.

24. A lock for use on a pair of by-passing type closure panels to lock the panels in a closed position with adjacent end portions of the panels in spaced overlapping relation, the lock comprising a lock housing having a lock plug mounted therein for axial sliding and rotary movement, a mounting plate rigid with the lock housing and extending laterally therefrom with a flat attaching face disposed in a plane perpendicular to the plug axis for mounting the housing on one closure panel, a rotary latch member mounted on the forward end of the plug for axial and rotary movement therewith, a reciprocable latch bolt mounted on the plug for axial sliding relative thereto and means yieldably urging the latch bolt forwardly relative to the plug to normally project the froward end of the bolt forwardly of the rotary latch member, said plug having a keyway and key operated means controlling rotation of said plug, means yieldably urging said plug to a retracted position in which the rotary latch member is adjacent the housing, said plug being axially movable from said retracted position to an extended position in which the rotary keeper is spaced forwardly from said housing and said plug being angularly movable between first and second angular positions under the control of said key, and an elongated keeper having means for mounting the same on the other closure panel to generally parallel the direction of its movement, said keeper having a first keeper means engageable with said rotary latch member when the latter is moved axially to an extended position and turned angularly to said second position for holding the plug against retraction and said keeper having a second keeper means engageable with said bolt when the rotary latch member engages said first keeper means to lock the plug and keeper against relative movement in one direction crosswise of the plug.

25. The combination of claim 24 wherein said keeper comprises an elongated plate having a flat attaching surface on one side thereof, said first keeper means including a pair of inwardly directed flanges along opposite lengthwise edges of the keeper plate and spaced from the other side of the keeper plate to form a pair of lengthwise extending grooves, and said second keeper means comprising recesses at spaced locations along the keeper plate between the flanges for receiving the forward end of the bolt.

26. The combination of claim 25 including an abutment on one end of the keeper extending laterally from said one side thereof for engaging the end edge of a closure panel.

27. The combination of claim 26 including means on said keeper adjacent its other end engageable with the rotary latch member on the plug for preventing relative movement in said one direction crosswise of the plug.

28. The combination of claim 25 including adhesive means on said flat attaching face of said mounting plate and on said flat attaching surface of said keeper plate for attaching the same to a closure panel.

* * * * *